United States Patent [19]

Zwald

[11] Patent Number: 4,754,197

[45] Date of Patent: Jun. 28, 1988

[54] ARC DISCHARGE LAMP ASSEMBLY SIMULATING GASLIGHT

[75] Inventor: John J. Zwald, Marblehead, Mass.

[73] Assignee: GTE Products Corporation, Danvers, Mass.

[21] Appl. No.: 918,444

[22] Filed: Oct. 14, 1986

[51] Int. Cl.[4] ..... H01J 7/44

[52] U.S. Cl. ..... 315/57; 315/58; 315/59; 362/255; 362/317; 313/44; 313/116; 313/635

[58] Field of Search ..... 315/57, 58, 59; 362/255; 313/317, 44, 116, 635

[56] References Cited

U.S. PATENT DOCUMENTS

| | | | |
|---|---|---|---|
| 1,350,853 | 8/1920 | Blumrick | 67/101 |
| 2,158,304 | 5/1939 | Rinnman | 67/101 |
| 3,148,835 | 9/1964 | Horelick | 362/255 |
| 4,173,730 | 11/1979 | Young et al. | 315/59 |
| 4,208,604 | 6/1980 | Couwenberg | 313/113 |
| 4,347,460 | 8/1982 | Latassa et al. | 315/63 |
| 4,374,340 | 2/1983 | Bouwknegt | 313/220 |
| 4,426,602 | 1/1984 | Mollet et al. | 315/58 |
| 4,481,442 | 11/1984 | Albrecht et al. | 313/493 |
| 4,495,443 | 6/1985 | Cummings | 315/58 |
| 4,577,265 | 3/1986 | Krause | 362/255 |
| 4,616,299 | 10/1986 | Krause | 362/255 |
| 4,623,823 | 11/1986 | Engel | 315/58 |

FOREIGN PATENT DOCUMENTS

| | | | |
|---|---|---|---|
| 1355598 | 1/1963 | France | 313/116 |

OTHER PUBLICATIONS

'Twin Tube Fluorescent System', GTE Products Corporation Brochure, Mar. 1985.

*Primary Examiner*—David K. Moore
*Assistant Examiner*—Mark R. Powell
*Attorney, Agent, or Firm*—Carlo S. Bessone

[57] ABSTRACT

An arc discharge lamp assembly simulating the appearance of a gaslight for installation in an existing incandescent light fixture. The assembly includes an arc discharge lamp having electrical contact means (e.g., a pair of contacts on the base of the lamp) located at one end thereof. A mantle supported by a wire frame substantially encloses the arc discharge lamp. In a preferred embodiment, the lamp includes at least two longitudinally extending leg members having a predetermined spacing therebetween and joined together by a transversely extending envelope portion. A diffusing means is disposed adjacent the leg members to provide an appearance of a substantially uniform light output from the entirety of the envelope during operation of the lamp. Preferably, the assembly further includes an adapter having a housing which contains a ballast and has a screw-in, incandescent-type base projecting from one surface thereof and a pair of contact receiving means on another surface thereof for mating with the pair of lamp base contacts.

18 Claims, 4 Drawing Sheets

ARC DISCHARGE LAMP ASSEMBLY SIMULATING GASLIGHT

TECHNICAL FIELD

This invention relates to arc discharge lamp assemblies and, more particularly, to such lamp assemblies which simulate the appearance of a gaslight.

BACKGROUND OF THE INVENTION

It is sometimes desirable to employ illuminating gaslights as in post lamps, entrance lights and street lamps to accomplish an aesthetic environment for a neighborhood characteristic of those in existence at the turn of the century. In many instances, however, it is impractical to employ illuminating gaslights for the reasons that either the supply of gas is unavailable, or the installation and maintenance of such gaslights is economically nonfeasible. Accordingly, it has become the practice to imitate the illuminating gaslights by the provision of glow-type electrical lamps rather than an intense illuminating light. The glow-type lamps have proven unsatisfactory since the mellow glow emitted therefrom is unlike that of the gaslights.

U.S. Pat. No. 3,148,835, which issued to Horelick on Sept. 15, 1964, discloses a simulated gaslight having an electrical incandescent lamp and a mantle fitted thereover to achieve the effect of an illuminating gas lamp. The efficiency of an incandescent lamp is known to be relatively low.

Because of the increasing cost of electrical energy, the substitution of initially costlier but more energy efficient lamp types in place of incandescent lamps has become practical. Prime candidates for this substitution are the fluorescent and high intensity discharge lamps because of their high luminous efficacies.

Compact fluorescent lamp assemblies are known in which the envelope of the lamp includes at least two longitudinally extending leg members joined together by a transversely extending envelope portion. One example of such a lamp, which is commercially available, is the "Twin-Tube" fluorescent lamp manufactured by GTE Sylvania, Danvers, Mass. Other examples of similar lamp types are disclosed in U.S. Pat. No. 4,374,340, which issued to Bouwknegt et al on Feb. 15, 1983; U.S. Pat. No. 4,426,602, which issued to Mollet et al on Jan. 17, 1984; and U.S. Pat. No. 4,481,442, which issued to Albrecht et al on Nov. 6, 1984.

U.S. Pat. No. 4,347,460, which issued to Latassa et al on Aug. 31, 1982, is one example of a compact fluorescent lamp assembly for use with an incandescent fixture including a lamp envelope having four spaced apart leg members.

In lamps of the above type wherein a plurality of spaced apart leg members are employed, the light output resulting from the lamp is generally non-uniform (i.e., the silhouette of the individual leg members are clearly distinguishable). In particular, lighting applications where the lamp envelope is clearly exposed, the appearance may be aesthetically displeasing.

BRIEF SUMMARY OF THE INVENTION

It is, therefore, an object of this invention to obviate the disadvantages of the prior art.

It is another object of the invention to provide an arc discharge lamp assembly which simulates the appearance of a gaslight but is more efficient than an incandescent lamp.

It is still another object of the invention to provide a more uniform light output from an arc discharge lamp for use in a gaslight simulative assembly and having at least two longitudinally extending leg members joined together by a transversely extending envelope portion.

It is still another object of the invention to provide an arc discharge lamp assembly which simulates the appearance of a gaslight wherein the upper lamp assembly portion can easily be replaced as a single unit upon failure of the lamp.

These objects are accomplished, in one aspect of the invention, by the provision of an arc discharge lamp assembly comprising an arc discharge lamp having electrical contact means located at one end thereof. A mantle substantially encloses the arc discharge lamp and has a substantially closed end portion and an open end portion. A wire frame is secured to the arc discharge lamp and extends alongside the mantle and has means for supporting the substantially closed end portion of the mantle. Preferably, the wire frame includes a pair of legs joined together by a connecting portion.

In accordance with still further teachings of the present invention, the arc discharge lamp is a fluorescent lamp. In a preferred embodiment, the fluorescent lamp comprises a sealed envelope of light transmitting vitreous material having a pair of end portions and including at least two longitudinally extending leg members having a predetermined spacing therebetween. The leg members are joined together by a transversely extending envelope portion. An ionizable medium is contained within the envelope and an electrode is located within each of the end portions. A phosphor layer is disposed on the internal surface of the envelope. Preferably, the arc discharge lamp includes a lamp base connected to the adjacently located end portions of the envelope with the electrical contact means being a pair of contacts projecting from a surface of the lamp base. A starter is preferably located within the lamp base.

In accordance with further teachings of the present invention, the arc discharge lamp assembly further includes clamping means for securing the open end portion of the mantle to the external surface of the lamp base. Preferably, the clamping means includes a wall portion having a pair of longitudinally extending sleeve members secured to or formed from the wall portion of the clamping means. Each of the longitudinally extending sleeve members defines an aperture for receiving a respective end of the legs of the wire frame.

In accordance with further aspects of the present invention, the arc discharge lamp assembly further includes diffusing means disposed adjacent the leg members of the envelope in a predetermined alignment with the predetermined spacing between the leg members of the envelope to provide an appearance of a substantially uniform light output from the entirety of the envelope during operation of the lamp. In a preferred embodiment, the diffusing means includes a longitudinally bifurcated member having two leg sections joined together by an intermediate section. Preferably, the diffusing means contains two oppositely disposed surfaces located respectively on the leg sections for contacting either the external surface of the leg members of the lamp or the external surface of the mantle. In a preferred embodiment, a hook-shaped protrusion projects from the intermediate section of the diffusing means for securing the diffusing means to the wire frame.

In accordance with still further aspects of the present invention, the means for supporting the substantially closed end portion of the mantle includes means for engaging the connecting portion of the wire frame. Preferably, the supporting means includes a cylindrically-shaped portion and a hook-shaped portion wherein the hook-shaped portion is formed to engage the connecting portion of the wire frame.

In accordance with still further teachings of the present invention, the electrical contact means is a pair of contacts projecting from a surface of a lamp base. Preferably, the arc discharge lamp assembly further includes an adapter having a housing which contains a ballast for energizing the lamp. The housing has a screw-in, incandescent-type base projecting from one surface thereof and a pair of contact receiving means on another surface thereof for mating with the pair of contacts on the lamp base.

BEST MODE FOR CARRYING OUT THE INVENTION

For a better understanding of the present invention, together with other and further objects, advantages and capabilities thereof, reference is made to the following disclosure and appended claims taken in conjunction with the above described drawings.

Figure 1:
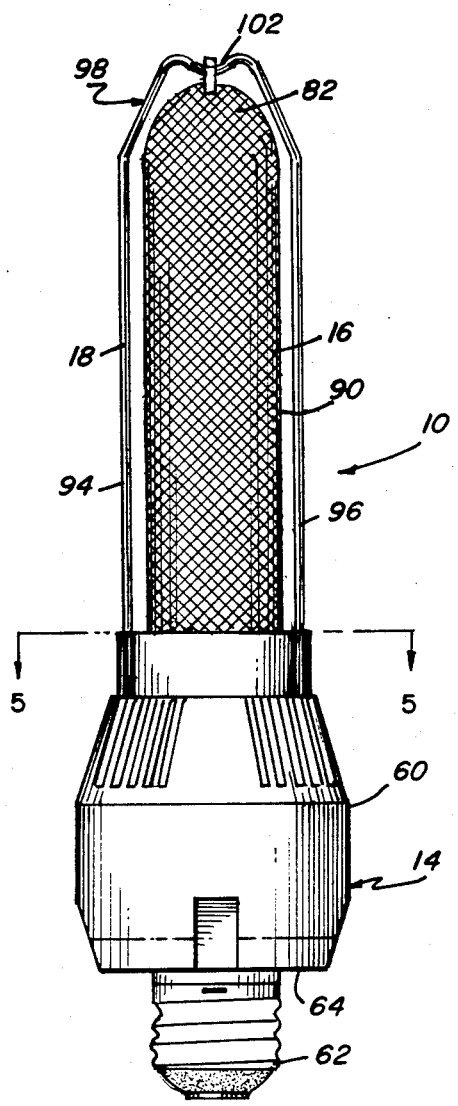
FIG. 1 is a front elevational view of an embodiment of an arc discharge lamp assembly according to the invention.
Figure 2:
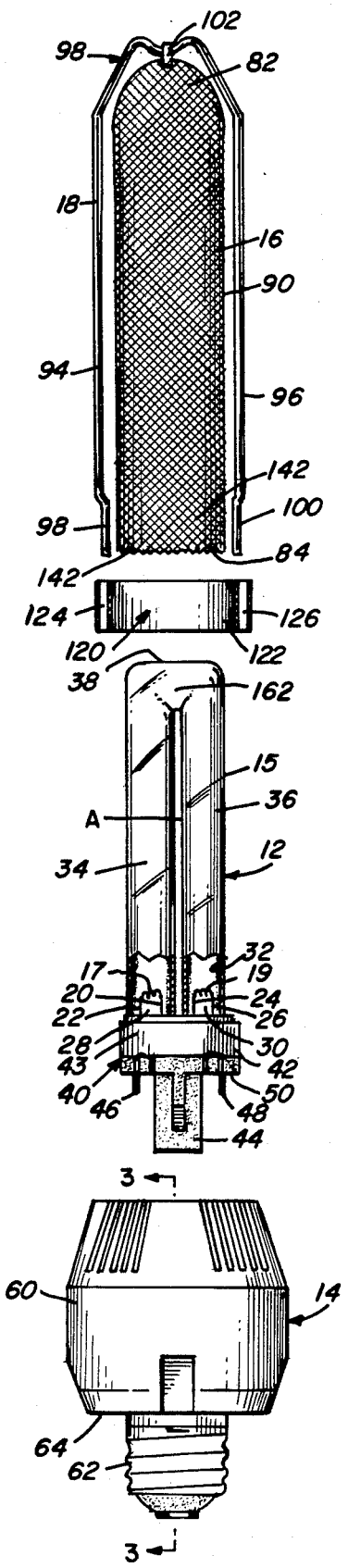
FIG. 2 is an exploded partially sectional view of the lamp assembly of FIG. 1.

Referring now to the drawings with greater particularity, there is shown in FIGS. 1 and 2 an arc discharge lamp assembly 10 for use with an incandescent light fixture. The incandescent light fixture may be incorporated into a post lamp, wall mounted lamp at an entranceway, various hanging fixtures, chandeliers or the like with the arc discharge lamp assembly of the present invention merely being screwed into the existing light socket instead of a conventional electric light bulb.

FIG. 2 shows an arc discharge lamp assembly 10 including an arc discharge lamp 12, an adapter 14, a mantle 16 and a wire frame 18.

The arc discharge lamp 12 may be, for example, a fluorescent or high intensity discharge lamp. Lamp 12 comprises a sealed envelope 15 of light-transmitting vitreous material, such as soda-lime or lead glass and having a pair of end portions 28, 30 and containing an ionizable medium including a quantity of mercury and an inert starting gas at low pressure, for example, in the order of 1–5 mm of mercury. The starting gas can be, for example, argon, krypton. neon or helium, or a mixture of these and other gases. An electrode 17, 19 supported by lead-in wires 20, 22 and 24, 26, respectively, is located within a respective end portion 28, 30 of envelope 15. Electrodes 17, 19 can be, for example, a double or triple-coiled tungsten filament of the usual type and carry a coating thereon which is usually in the form of alkaline earth oxides applied thereto in the form of carbonates which, upon processing, are converted to oxides. A phosphor layer 32, which converts the ultraviolet radiation generated in the mercury discharge into visible radiation, is disposed on the internal surface of envelope 15. Preferably, envelope 15 has at least first and second parallel, longitudinally extending leg members 34, 36 joined together by a transversely extending envelope portion 38. Alternatively, the transversely extending envelope portion may be of the forms as shown in U.S. Pat. Nos. 4,374,340 and 4,481,442. Leg members 34 and 36 are spaced a predetermined distance D1 apart (FIGS. 8 and 10), such as about 2.0 millimeters. Alternatively, envelope 15 of lamp 12 may comprise a plurality of leg members (such as four) disposed in a substantially quadrangular or quadralinear (i.e., in the same plane) columnar array and joined together by a plurality of transversely extending envelope portions to form a single elongated discharge path. Each of the leg members is spaced a predetermined distance apart from an adjacent leg member. The distances between adjacent leg members may be equal or may vary. As best shown in FIG. 2, lamp end portions 28, 30 may be adjacently located and connected to a suitable lamp base 40 including a generally oval-shaped upper portion 42 having an external surface 43 and a lower portion 44. A conventional starter (not shown) including a conventional glow bottle and radio interference capacitor is located within lower portion 44 and is electrically connected to lead-in wires 20 and 24. A pair of electrical contacts 46, 48 project from a surface 50 of lamp base 40 and are electrically connected to lead-in wires 22, 26, respectively. Examples of suitable lamps are shown and described in U.S. Pat. Nos. 4,426,602 and 4,481,442.

Figure 3:
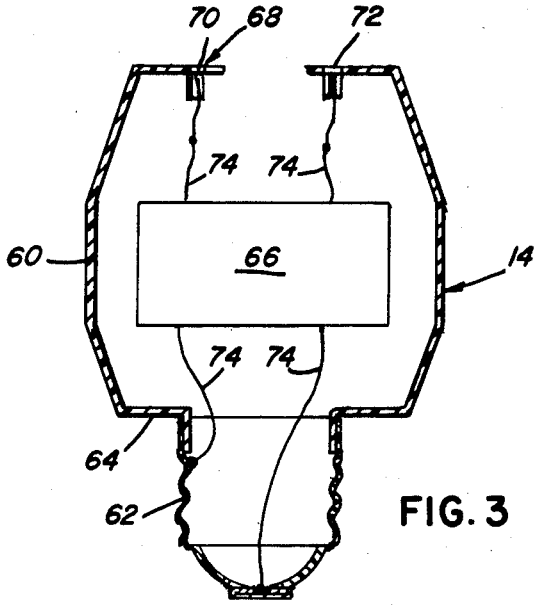
FIG. 3 is a partially sectional view of the adapter portion of the lamp assembly taken along the line 3—3 in FIG. 2.

Adapter 14, as best shown in the partially sectional view in FIG. 3, includes a housing 60 of electrically insulating material having a screw-in, incandescent-type base 62 projecting from one surface 64 of housing 60 for mating with a threaded socket of an existing light fixture. A pair of contact receiving means 68, for example, sockets 70, 72 is located on another surface of housing 60 for respective mating with lamp contacts 46, 48 which project from surface 50 of lamp base 40 (in FIG. 2). A ballast means 66 which can include a conventional choke coil or electronic ballasting circuit is contained within housing 60 of adapter 14 and together with the necessary electrical wiring 74 electrically connects incandescent-type base 62 to sockets 70, 72. An example of a suitable adapter is shown and described in U.S. Pat. No. 4,624,513.

As best shown in FIGS. 1 and 2, arc discharge lamp assembly 10 further comprises a generally cylindrically-shaped mantle 16 substantially enclosing arc discharge lamp 12. Mantle 16 is a woven mesh which is made of, for example, cotton, silk or plastic material content. Mantle 16 has a substantially closed end portion 82 and an open end portion 84. Because of the close proximity of the mantle to the lamp, we have discovered that the mantle tends to warm the lamp exterior and thereby allows the lamp to function in much colder ambient temperatures than without the woven cover. The protection afforded by the mantle cover makes a compact fluorescent generally intended for inside use to be able to function outside to lower temperatures. Lamp 12 is inserted into the open end portion 84 of mantle 16 during assembly to substantially enclose lamp 12.

Figure 4:
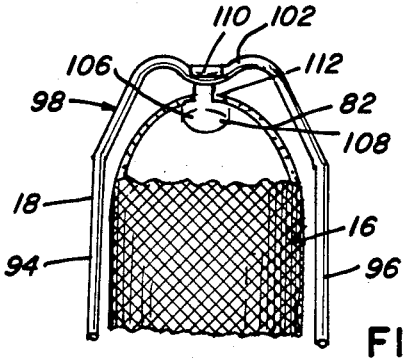
FIG. 4 is a partially broken away view of an embodiment according to the invention.
Figure 6:
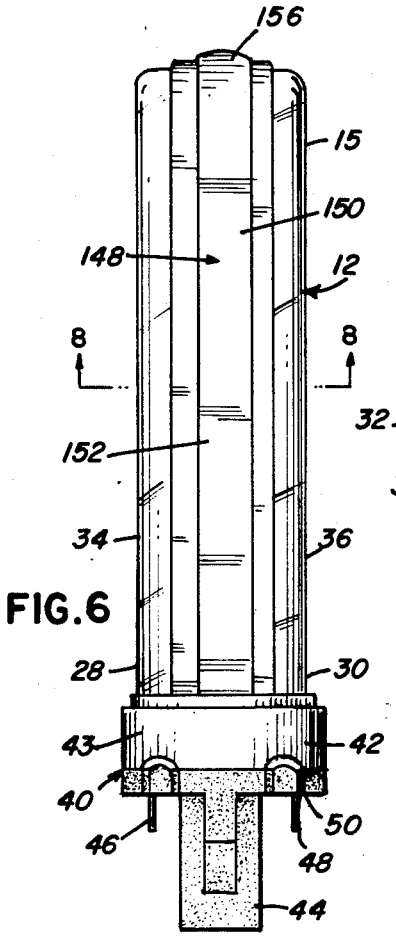
FIG. 6 is a front elevational view of an embodiment of a lamp with diffusing means according to the invention.

Preferably, substantially closed end portion 82 of mantle 16 is supported by a wire frame 18 (FIGS. 1 and 2) extending alongside the external surface 90 of mantle 16. Wire frame 18 includes a pair of legs 94, 96 joined together by an inverted W-shaped connecting portion 98. The center portion 102 of inverted W-shaped connecting portion 98 is connected to the closed end portion 82 of mantle 16 by means of looped threads of fabric or metallic material. Alternatively, as best shown in FIG. 4, substantially closed end portion 82 of mantle 16 may be supported by means of a connecting member 106 of plastic material which includes a cylindrically-shaped portion 108 and a hook-shaped portion 110 for engaging center portion 102 of connecting portion 98 of wire frame 18. The diameter of cylindrically-shaped portion 108 is greater than an opening 112 in closed end portion 82 in mantle 16 through which hook-shaped portion 110 protrudes in order to support mantle 16. Hook-shaped portion 110 is snapped to center portion 102 of connecting portion 98 of wire frame 18.

Figure 5A:
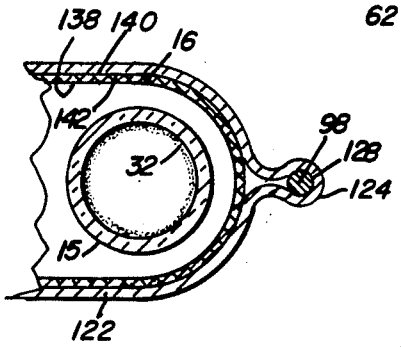
FIG. 5*a* is an exploded partial view of a section of FIG. 5.
Figure 5:
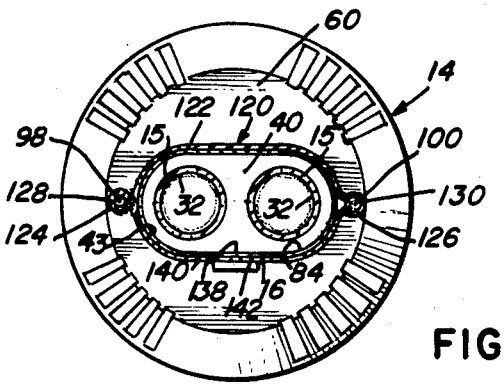
FIG. 5 is a partially sectional view of the lamp assembly taken along the line 5—5 in FIG. 1.

In accordance with further teachings of the present invention, open end portion 84 of mantle 16 and wire frame 18 are secured to lamp base 40 of arc discharge lamp 12 by clamping means 120. Preferably, clamping means 120 as best shown in FIGS. 2 and 5 includes a wall portion 122 having a pair of cylindrically-shaped sleeve members 124, 126 secured to or formed from wall portion 122 and extending in a longitudinal direction. The internal surface 138 of open end portion 84 of mantle 16 contacts the external surface 43 of lamp base 40 while the internal surface 140 of wall portion 122 contacts the external surface 142 of open end portion 84 of mantle 16. Each of the cylindrically-shaped sleeve members 124, 126 defines an aperture 128, 130 to receive ends 98, 100 of legs 94, 96 of wire frame 18, respectively. Wire frame 18 is made of a resilient material so that ends 98, 100 of legs 94, 96, which are generally spaced a distance greater than the distance between aperture 128, 130, will be frictionally retained within cylindrically-shaped sleeve members 124, 126 upon lateral compression of legs 94, 96 and then relaxation thereof. Securing at least the wire frame 18 to lamp base 40 of lamp 12 allows the upper portion of assembly 10, which includes at least lamp 12, mantle 16 and wire frame 18, to be easily replaced as a single unit upon failure of the lamp. Alternatively, clamping means 120 may be used to secure only the wire frame 18 to lamp base 40 of arc discharge lamp 12. In this particular instance, the internal surface 140 of wall portion 122 contacts the external surface 43 of lamp base 40.

Figure 8:
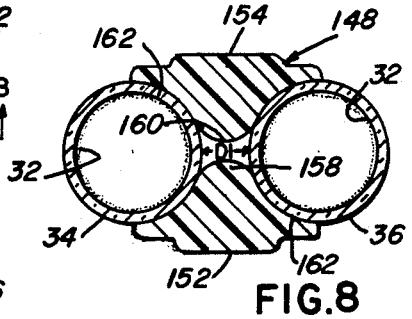
FIG. 8 is an enlarged cross-sectional view of the lamp with diffusing means taken along the line 8—8 in FIG. 6.
Figure 9:
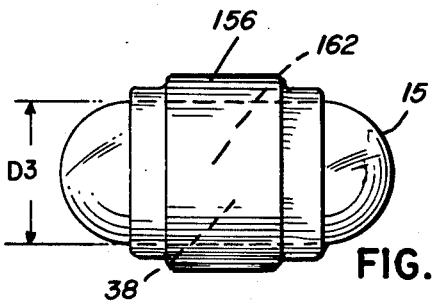
FIG. 9 is an enlarged plan view of the lamp with diffusing means as shown in FIG. 6.
Figure 10:
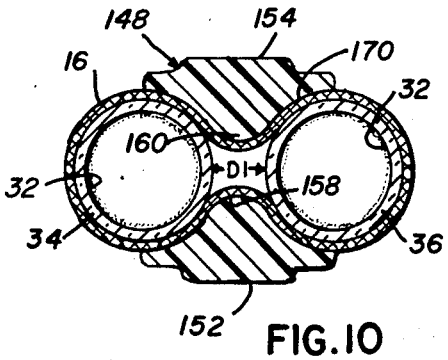
FIG. 10 is an enlarged cross-sectional view of an embodiment of a lamp with diffusing means and mantle according to the invention.

In accordance with the further teachings of the present invention, lamp 12 as shown in FIGS. 6–10 is provided with a diffusing means 148 disposed adjacent the leg members of the envelope in a predetermined alignment with predetermined spacing D1 between the leg members to provide an appearance of a substantially uniform light output from the entirety of the envelope during operation of the lamp. The substantially uniform light output is such that the actual outline or shape of the envelope is obscured by the diffusing means. Diffusing means 148 covers an area A (FIG. 2) defined between lamp leg members 34, 36 to diffuse the light from the lamp leg members by "filling in" area A with light and thereby avoiding the appearance of separate leg members. Preferably, diffusing means 148 is in the form of a longitudinally bifurcated member 150 having two leg sections 152, 154 joined together by a generally U-shaped intermediate section 156. As best shown in FIG. 8, diffusing means 148 has two oppositely disposed substantially wedge-shaped surfaces 158, 160 on leg sections 152, 154, respectively, for engaging the external surface 162 of lamp leg members 34, 36. Alternatively, as shown in FIG. 10, diffusing means 148 may be mounted over mantle 16 wherein oppositely disposed surfaces 158, 160 contact the external surface 170 of mantle 16 which is sandwiched between the two leg sections 152, 154 and lamp leg members 34, 36. The U-shaped intermediate section 156 of diffusing means 148 defines a circular opening 159 to receive transversely extending portion 38 of envelope 15. Preferably, the internal surface of intermediate section 156 contacts a portion of the external surface 162 of transversely extending envelope portion 38 of envelope 15. Circular opening 159 has a diameter D2 (FIG. 7) equal to at least the outside diameter D3 (FIG. 9) of transversely extending envelope portion 38. Circular opening 159, which conforms to the transversely extending envelope portion 38, aids in retaining bifurcated member 150 in place by preventing undesired longitudinal movement. Lateral movement of bifurcated member 150 is prevented by substantially wedge-shaped surfaces 158, 160 on leg sections 152, 154, respectively. Member 150 can be made of, for example, any translucent, resilient plastic material suitable of being easily snapped over a manufactured lamp and which will diffuse light so that the individual lamp leg members cannot be clearly distinguishable during operation of the lamp. To remove the diffuser upon failure of lamp 12, leg sections 152 and 154 are spread apart slightly while moving bifurcated member 150 in a longitudinal direction. Alternatively, as shown in FIG. 10, surfaces 158, 160 on leg sections 152, 154, respectively, engage the external surface 170 of mantle 16.

Figure 7:
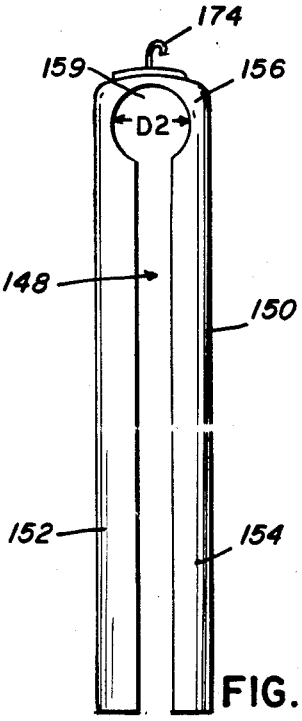
FIG. 7 is a front elevational view of an embodiment of a diffusing means according to the invention.

As shown in FIG. 7, diffusing means 148 may include a hook-shaped protrusion 174 projecting from intermediate section 156 for securing diffusing means 148 to center portion 102 of wire frame 18 (FIG. 4).

While there have been shown and described what are at present considered to be the preferred embodiments of the invention, it will be apparent to those skilled in the art that various changes and modifications can be made herein without departing from the scope of the invention as defined by the appended claims. For example, the arc discharge lamp assembly may not include a separate adapter, such that the ballast may be remotely located or located in an integral base of the lamp.

What is claimed is:

1. An arc discharge lamp assembly comprising:

an arc discharge lamp having electrical contact means located at one end thereof and including a sealed envelope of light transmitting vitreous material having a pair of end portions and including at least two longitudinally extending leg members spaced a predetermined distance thereapart, said leg members being joined together by a transversely extending envelope portion, an ionizable medium contained within said envelope, an electrode located within each of said end portions, and a phosphor layer disposed on the internal surface of said envelope;

a diffusing means disposed adjacent said leg members of said envelope in a predetermined alignment with said predetermined spacing between said leg members of said envelope to provide an appearance of a substantially uniform light output from the entirety of said envelope during operation of said lamp;

a mantle substantially enclosing said arc discharge lamp and having a substantially closed end portion and an open end portion; and a wire frame secured to said arc discharge lamp and extending alongside said mantle and having means for supporting said substantially closed end portion of said mantle.

2. The arc discharge lamp assembly of claim 1 wherein said arc discharge lamp is a fluorescent lamp.

3. The arc discharge lamp assembly of claim 2 wherein said end portions of said envelope are adjacently located.

4. The arc discharge lamp assembly of claim 3 wherein said arc discharge lamp further includes a lamp base connected to said end portions of said envelope. said electrical contact means being a pair of contacts projecting from a surface of said lamp base.

5. The arc discharge lamp assembly of claim 4 wherein a starter is included within said base.

6. The arc discharge lamp assembly of claim 4 wherein said wire frame includes a pair of legs joined together by a connecting portion, each of said legs of said wire frame having an end.

7. The arc discharge lamp assembly of claim 6 further including clamping means for securing said open end portion of said mantle to said lamp base.

8. The arc discharge lamp assembly of claim 7 wherein said clamping means includes a wall portion having a pair of longitudinally extending sleeve members secured to or formed from said wall portion of said clamping means, each of said longitudinally extending sleeve members defining an aperture for receiving a respective end of said legs of said wire frame.

9. The arc discharge lamp assembly of claim 1 wherein said wire frame includes a pair of legs joined together by a connecting portion.

10. The arc discharge lamp assembly of claim 9 wherein said means for supporting said substantially closed end portion of said mantle includes means for engaging said connecting portion of said wire frame.

11. The arc discharge lamp assembly of claim 1 wherein said electrical contact means is a pair of contacts, said arc discharge lamp assembly further including an adapter having a housing containing a ballast for energizing said arc discharge lamp, said housing having a screw-in, incandescent-type base projecting from one surface thereof and a pair of contact receiving means on another surface thereof for mating with said pair of contacts.

12. The arc discharge lamp assembly of claim 11 wherein said arc discharge lamp further includes a lamp base connected thereto, said lamp base having said pair of contacts projecting from a surface thereof.

13. The arc discharge lamp assembly of claim 1 wherein said diffusing means includes a longitudinally bifurcated member having two leg sections joined together by an intermediate section.

14. The arc discharge lamp assembly of claim 13 wherein said diffusing means contains two oppositely disposed surfaces located respectively on said leg sections.

15. The arc discharge lamp assembly of claim 14 wherein said two oppositely disposed surfaces contact the external surface of said leg members of said envelope.

16. The arc discharge lamp assembly of claim 14 wherein said two oppositely disposed surfaces contact the external surface of said mantle.

17. The arc discharge lamp assembly of claim 13 wherein a hook-shaped protrusion projects from said intermediate section of said diffusing means for securing said diffusing means to said wire frame.

18. An arc discharge lamp assembly comprising:

an arc discharge lamp having electrical contact means located at one end thereof;

a mantle substantially enclosing said arc discharge lamp and having a substantially closed end portion and an open end portion;

a wire frame including a pair of legs joined together by a conducting portion secured to said arc discharge lamp and extending alongside said mantle and having means for supporting said substantially closed end portion of said mantle, said supporting means includes a cylindrically-shaped portion and a hook-shaped portion, said hook-shaped portion being formed to engage said connecting portion of said wire frame.

* * * * *